US008196539B2

(12) United States Patent
Leverette et al.

(10) Patent No.: US 8,196,539 B2
(45) **Date of Patent: *Jun. 12, 2012**

(54) BATTERED COLUMN OFFSHORE PLATFORM

(75) Inventors: Steven J. Leverette, Richmond, TX (US); Oriol R. Rijken, Houston, TX (US); Peter A. Lunde, Cypress, TX (US); Stephen E. Kibbee, Houston, TX (US); John O. Telders, The Hague (NL)

(73) Assignee: Seahorse Equipment Corporation, Houston, TX (US)

( * ) Notice: Subject to any disclaimer, the term of this patent is extended or adjusted under 35 U.S.C. 154(b) by 252 days.

This patent is subject to a terminal disclaimer.

(21) Appl. No.: 12/470,839

(22) Filed: May 22, 2009

(65) Prior Publication Data

US 2010/0074693 A1 Mar. 25, 2010

Related U.S. Application Data

(63) Continuation-in-part of application No. 12/255,579, filed on Oct. 21, 2008, now Pat. No. 8,087,849, which is a continuation-in-part of application No. 11/364,505, filed on Feb. 28, 2006, now Pat. No. 7,462,000.

(51) Int. Cl.
*B63B 35/44* (2006.01)

(52) U.S. Cl. ..... 114/265; 405/223.1; 405/224

(58) Field of Classification Search ..... 114/264, 114/265, 266; 405/195.1, 196, 200, 223.1, 405/224, 224.2, 224.3, 224.4

See application file for complete search history.

(56) References Cited

U.S. PATENT DOCUMENTS

| | | | | |
|---|---|---|---|---|
| 3,996,755 | A * | 12/1976 | Kalinowski | 114/265 |
| 4,043,138 | A * | 8/1977 | Stageboe et al. | 405/205 |
| 4,646,672 | A * | 3/1987 | Bennett et al. | 114/264 |
| 4,793,738 | A * | 12/1988 | White et al. | 405/223.1 |
| 6,666,624 | B2 | 12/2003 | Wetch | |
| 6,761,124 | B1 * | 7/2004 | Srinivasan | 114/264 |
| 6,899,492 | B1 | 5/2005 | Srinivasan | |
| 7,140,317 | B2 | 11/2006 | Wybro et al. | |
| 7,462,000 | B2 * | 12/2008 | Leverette et al. | 405/223.1 |
| 2001/0026733 | A1 * | 10/2001 | Ludwigson | 405/224.2 |
| 2006/0260526 | A1 * | 11/2006 | Kristensen et al. | 114/264 |
| 2007/0201954 | A1 | 8/2007 | Leverette et al. | |

* cited by examiner

*Primary Examiner* — Lars A Olson
(74) *Attorney, Agent, or Firm* — Nick A. Nichols, Jr.

(57) ABSTRACT

An offshore platform includes a buoyant hull comprising three or more interconnected pontoons and a plurality of support columns. The support columns support a deck or structure that supports equipment and/or payloads above a water surface. The support columns extend upwardly from respective ends of the pontoons to the deck or structure supported above the water surface. Anchoring members anchor the platform to the seabed.

18 Claims, 13 Drawing Sheets

BATTERED COLUMN OFFSHORE PLATFORM

CROSS-REFERENCE TO RELATED APPLICATION

This application is a continuation-in-part application of U.S. application Ser. No. 12/255,579, filed Oct. 21, 2008, now U.S. Pat. No. 8,087,849 which is a continuation-in-part application of U.S. application Ser. No. 11/364,505, filed Feb. 28, 2006, now U.S. Pat. No. 7,462,000.

BACKGROUND OF THE DISCLOSURE

The present invention relates to offshore floating structures for installation and use in offshore operations.

Offshore floating structures (generally referred to herein as "platforms"), such as tension leg platforms (TLP), semi-submersible platforms, radar stations, offshore wind farms and the like may be anchored to the seabed and held in place in the ocean by means of mooring systems, such as tendons, steel catenary risers or similar mooring structures, which are typically fabricated from high strength, high quality steel tubulars, and include articulated connections on the top and bottom for connection to the floating structure and seabed anchor, respectively, that reduce bending moments and stresses in the tendon system. Many factors must be taken into account in designing an offshore floating platform to safely transport it to the installation site and keep it safely in place including: (a) limitation of stresses developed in the mooring system during extreme storm events and while the platform is operating in damaged conditions; (b) avoidance of any slackening of the mooring system and subsequent snap loading or disconnect of mooring system as wave troughs and crests pass the platform hull; (c) allowance for fatigue damage which occurs as a result of the stress cycles in the mooring system throughout its service life; (d) limit natural resonance (heave, pitch, roll) motions of the platform to ensure adequate functional support for personnel, equipment, and risers; (e) maximizing the hydrostatic stability of the platform during transport and installation; and (e) accommodating additional requirements allowing for fabrication, transportation, and installation.

These factors have been addressed in the prior art with varying degrees of success. Conventional multi-column offshore platforms, for example, generally have four vertical columns interconnected by pontoons supporting a deck on the upper ends of the vertical columns. Tendons connected at the lower ends of the columns anchor the platform to the seabed. In such conventional designs, the footprints of the deck, the vertical columns and the tendons are substantially the same and therefore hydrostatic stability of the platform can be a problem.

The present invention, in its various embodiments, addresses the above-described factors to accommodate different payload requirements, various water depths and to improve hydrostatic stability and hydrodynamic characteristics of the floating platform.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 16 is a perspective view illustrating a thirteenth preferred embodiment of an offshore platform of the present invention;

DETAILED DESCRIPTION OF A PREFERRED EMBODIMENT

Figure 1:
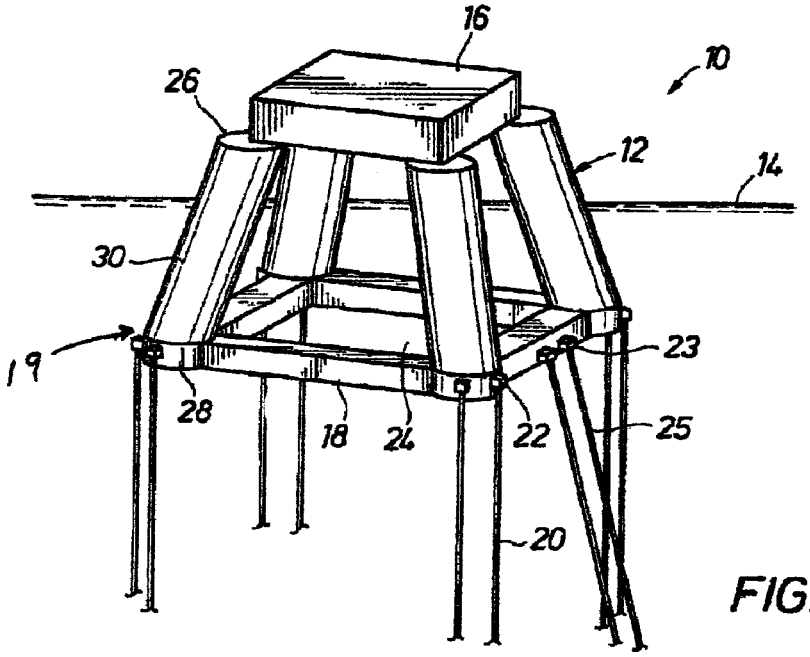
FIG. 1 is a perspective view illustrating a first preferred embodiment of an offshore platform of the present invention.

Referring first to FIG. 1, a first embodiment of an offshore platform of the present invention is generally identified by the reference numeral 10. The platform 10 includes four columns 12 having upper ends projecting above the water surface 14 for engaging and supporting a deck 16 thereon. As used herein the term "deck" is defined in a broad sense to mean a structure that supports equipment and/or payload above a water surface. Horizontally disposed pontoons 18 interconnect adjacent columns 12 proximate the lower ends thereof. The platform 10 is anchored to the seabed by tendons 20. The upper ends of one, two or more tendons 20 are connected at each column 12 and the lower ends thereof are anchored to the seabed. Tendon porches 22 mounted proximate to and outboard of the lower ends of the columns 12 secure the tendons 20 to the columns 12.

The columns 12 and pontoons 18 form an open structure hull 19 for supporting the deck 16 and the equipment mounted thereon above the water surface 14. The deck 16 is supported above the water surface 14 on the upper ends 26 of the columns 12. The open structure of the hull 19 provides improved wave transparency and further defines a moonpool 24 providing access to the seabed through the moonpool 24 from the deck 16. The columns 12 form the corners of the hull 19 and are battered or inclined inwardly toward the central longitudinal axis of the hull 19. Preferably, the columns 12 are battered inwardly at an angle less than 20 degrees from vertical.

Referring still to FIG. 1, the columns 12 include a substantially vertical section 28 forming the lower ends of the columns 12 and an inclined or battered section 30 terminating at the upper ends 26 of the columns 12. The lower ends 28 of the columns 12 provide a vertical perimeter structural surface for connection of the pontoons 18 thereto. The tendon porches 22 are fixed to and extend outward from the lower ends 28 of the columns 12. Connectors 23 may be fixed to and extend inward or outward from the pontoons 18 for supporting risers 25, flow lines or the like from the pontoons 18. In addition, the platform 10 may be provided with one or more catenary mooring lines or one or more lateral mooring lines to compensate for the weight of any risers or midwater pipelines connected to the platform 10.

Figure 2:
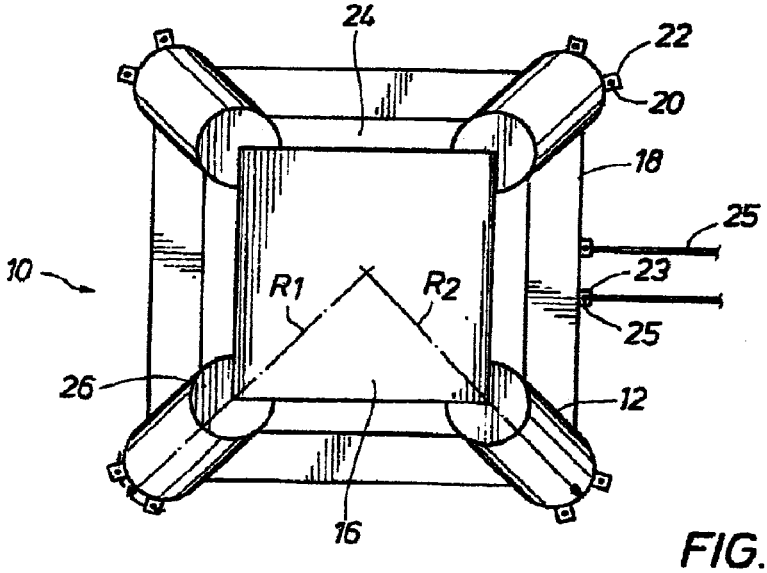
FIG. 2 is a top view of the offshore platform shown in FIG. 1.

Floating platform systems are typically limited structurally to the amount of displacement that can be allocated to the pontoons 18 without the columns 12 getting structurally too "skinny", especially in deep draft configurations. Battering the columns 12 enables optimization of the pontoons/columns design. In a conventional four column platform, the deck is supported by vertical columns interconnected by pontoons or similar structural members. Consequently, the perimeter dimensions or footprints of the deck and the vertical support columns of a conventional platform are about equal. The payload capacity of the platform is therefore limited by the load carrying capacity of the deck support columns. This structural limitation may be overcome by battering the columns 12 so that the footprint of the columns 12, defined by the perimeter dimension of the lower ends 28 of the columns 12, is larger than the deck 16 footprint defined by the perimeter dimension of the upper ends 26 of the columns 12. The battered columns 12 provide an efficient load transfer path for balancing deck weight, hull buoyancy, and tendon tension loads. All loads are direct acting through the columns 12, without large cantilevers or large moment forces. As best shown in FIG. 2, the radial distance $R_1$ of the tendons 20 footprint from the central longitudinal axis of the platform 10 is substantially equal to or slightly greater than the radial distance $R_2$ of the columns 12 footprint. Preferably, the radial distance $R_1$ of the tendons 20 footprint is less than 10% greater than the radial distance $R_2$ of the columns 12 footprint.

Figure 3:
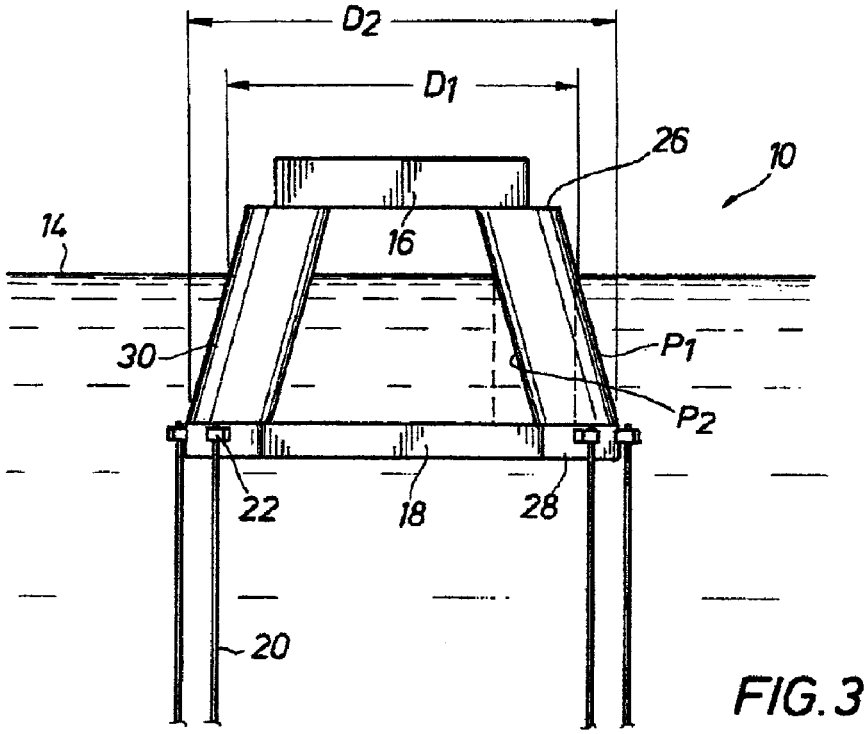
FIG. 3 is a side view of the offshore platform shown in FIG. 1.

Various modes of transportation may be utilized to transport a platform or components thereof to the installation site. When the hull and deck are assembled at the fabrication yard, the hull-and-deck assembly may be free floated to the installation site. For free floating conditions of the hull-and-deck assembly (such as deck integration, loading and unloading from a transport vessel, and towing to the installation site), hydrodynamic and/or hydrostatic stability is most lacking at shallow draft when the vertical center of gravity of the hull-and-deck assembly is high. The battered columns 12 of the platform 10 provide a larger water plane dimension at shallower drafts of the free floating hull-and-deck assembly than a conventional platform with vertical columns. As best illustrated in FIG. 3, the water plane dimension of the hull-and-deck assembly at the water surface 14 for a first draft position is represented by the line $D_1$. At a shallower second draft position, the larger water plane dimension of the hull-and-deck assembly is represented by the line $D_2$. Unlike the water plane dimension of a conventional platform, which is the same at all drafts, the water plane dimension of the platform 10 is variable. The water plane dimension of the platform 10 increases as the draft of the platform 10 decreases, thereby maximizing platform stability at shallower drafts where it is most needed.

In addition, inclination of the columns 12 imparts pontoon-like hydrodynamic and/or hydrostatic properties to the columns 12 which may be best understood by visualizing a horizontal cross section through the columns 12 at the water surface 14 and a shadow (shown in phantom in FIG. 3) formed by the sun located directly above. The portion $P_1$ of the columns 12 that is not under the shadow of the surface water plane has water acting both above and below, whereas the portion $P_2$ of the columns 12 that is under the shadow of the surface water plane has water acting only from below. The balance between the surface piercing buoyancy of the columns 12 and the non-surface piercing buoyancy of the pontoons 18 may therefore be modified without changing the actual dimensions of the columns 12 and pontoons 18 by increasing or decreasing the draft of the platform 10.

Figure 4:
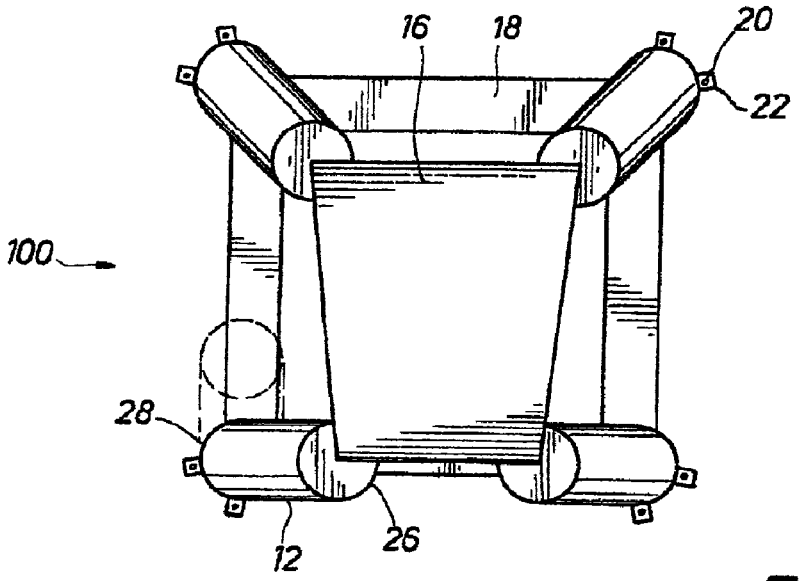
FIG. 4 is a top view illustrating a second preferred embodiment of an offshore platform of the present invention.

Referring now to FIG. 4, a second embodiment of a battered column platform of the present invention is generally identified by the reference numeral 100. The platform 100 is substantially the same as platform 10 described hereinabove with the exception that two of the columns 12 are battered toward each other above the pontoons 18. It is understood however that the columns 12 may be inclined inwardly at any azimuth angle direction between 0° (shown in solid line) and 90° (shown in phantom). Thus, the platform design of the present invention may accommodate various sizes and shapes of the deck 16 and payload capacity without changing the actual dimensions of the columns 12 and the pontoons 18.

Figure 5:
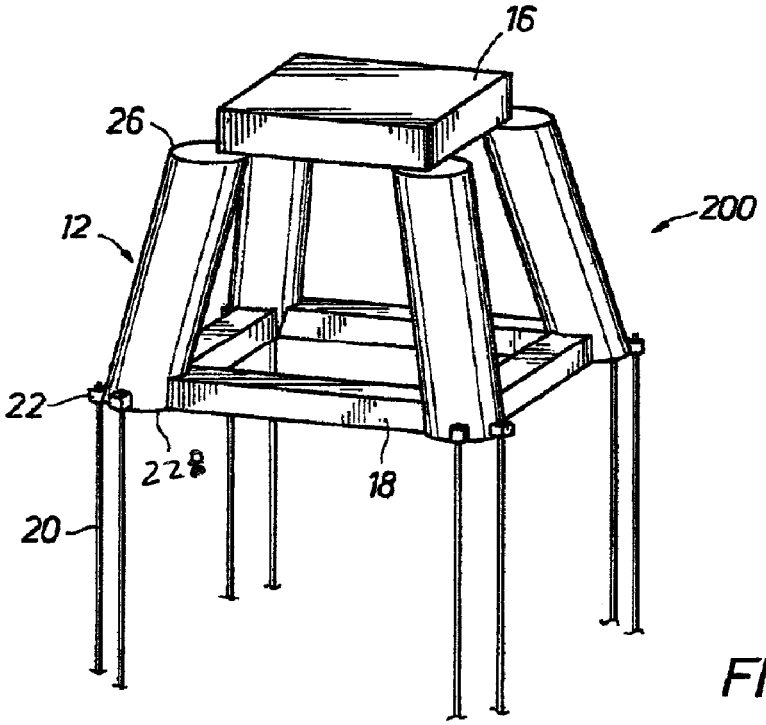
FIG. 5 is a perspective view illustrating a third preferred embodiment of an offshore platform of the present invention.

Referring now to FIG. 5, a third embodiment of a battered column platform of the present invention is generally identified by the reference numeral 200. The platform 200 is substantially the same as the platform 10 described hereinabove with the exception that the lower ends of the columns 12 do not include a vertical dimension. The columns 12 illustrated in FIG. 5 are inclined inwardly from the lower ends 228 to the upper ends 26 thereof.

Figure 6:
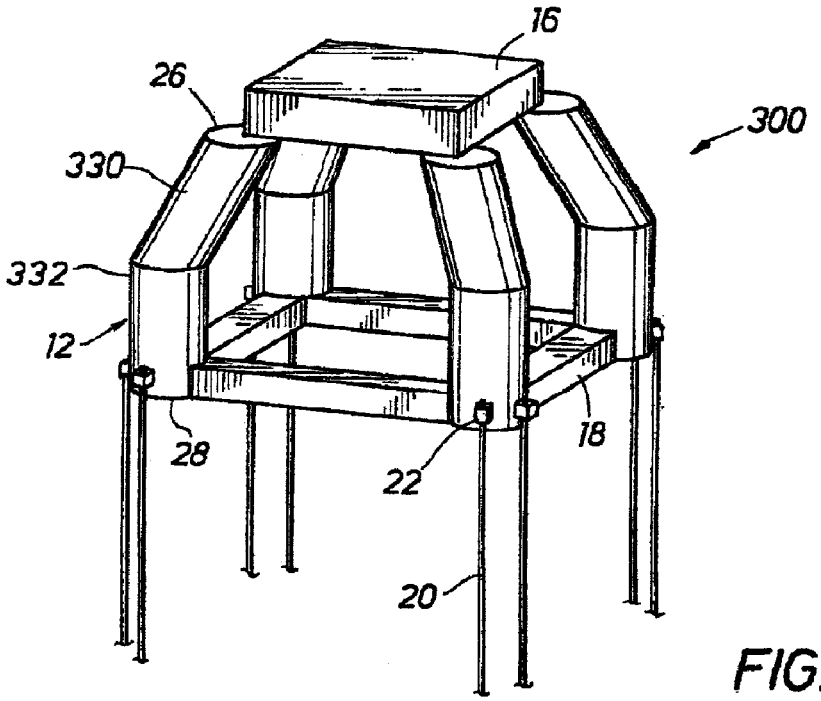
FIG. 6 is a perspective view illustrating a fourth preferred embodiment of an offshore platform of the present invention.

Referring now to FIG. 6, a fourth embodiment of a battered column platform of the present invention is generally identified by the reference numeral 300. The platform 300 is substantially the same as the platform 10 described hereinabove with the exception that the columns 12 include a battered section 330 extending inwardly from an intermediate point 332 between the upper ends 26 and the lower ends 28 of the columns 12.

Figure 7:
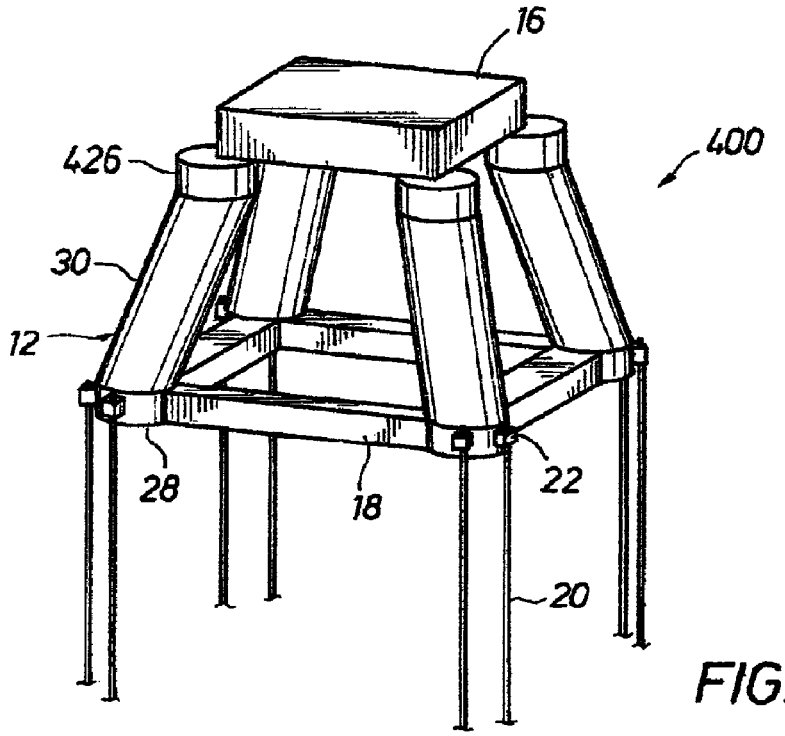
FIG. 7 is a perspective view illustrating a fifth preferred embodiment of an offshore platform of the present invention.

Referring now to FIG. 7, a fifth embodiment of a battered column platform of the present invention is generally identified by the reference numeral 400. The platform 400 is substantially the same as the platform 10 described hereinabove with the exception that the columns 12 include a substantially vertical section 426 forming the upper ends of the columns 12 and an inclined or battered section 30 extending between the upper ends 426 and the lower ends 28 of the columns 12.

Figure 8:
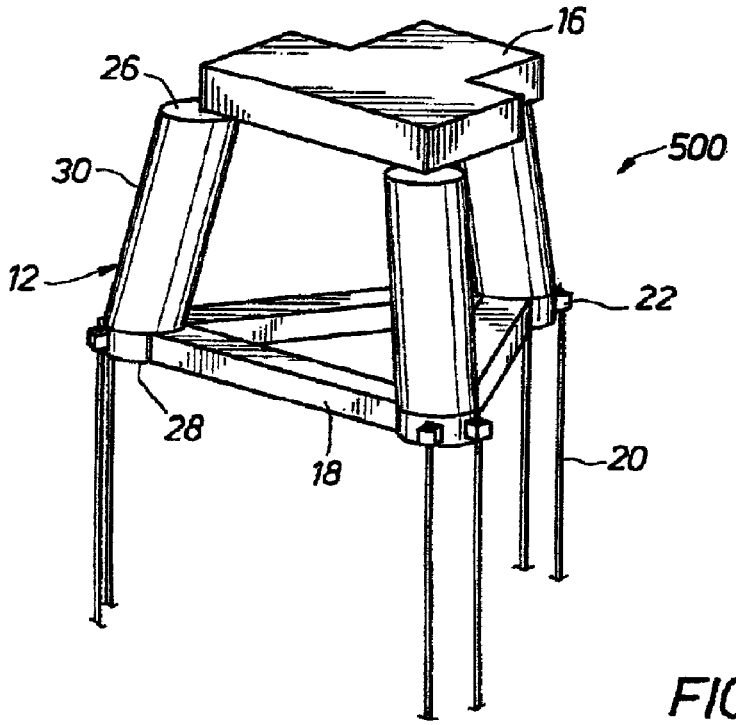
FIG. 8 is a perspective view illustrating a sixth preferred embodiment of an offshore platform of the present invention.

Referring now to FIG. 8, a sixth embodiment of a battered column platform of the present invention is generally identified by the reference numeral 500. The platform 500 is substantially the same as the platform 10 described hereinabove with the exception that the hull of the platform 500 comprises three battered columns 12 interconnected by the pontoons 18 at the lower ends 28 and supporting the deck 16 at the upper ends 26 thereof.

Figure 9:
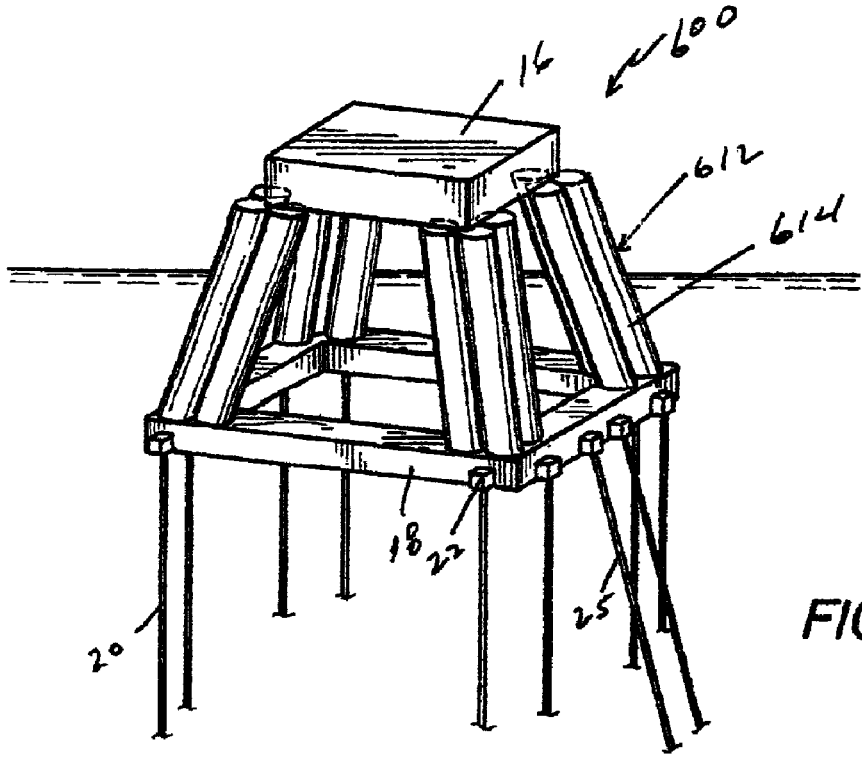
FIG. 9 is a perspective view illustrating a seventh preferred embodiment of an offshore platform of the present invention.
Figure 10:
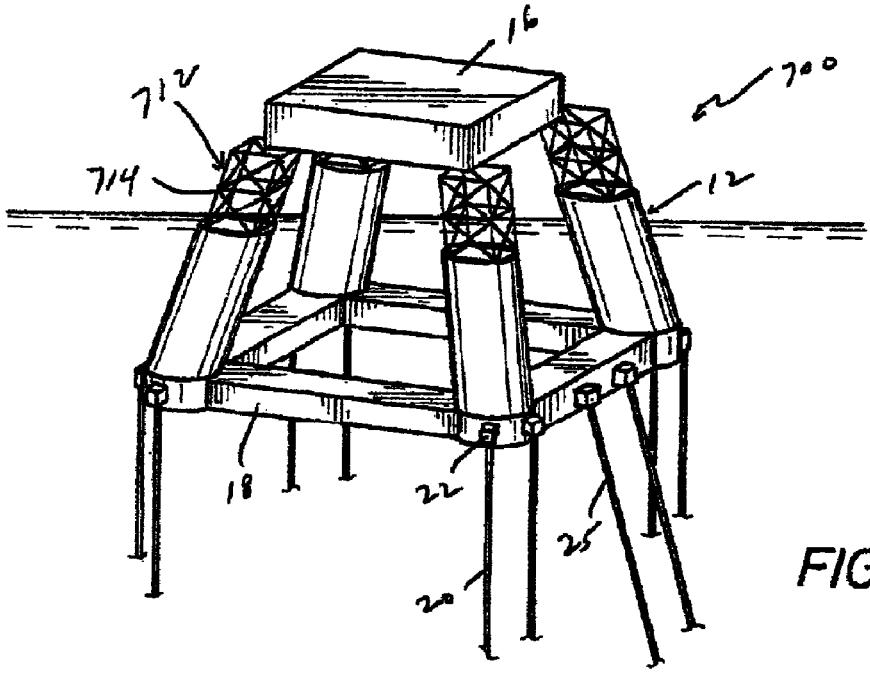
FIG. 10 is a perspective view illustrating an eighth preferred embodiment of an offshore platform of the present invention.

Referring now to FIG. 9, a seventh embodiment of a battered column platform of the present invention is generally identified by the reference numeral 600. The platform 600 is substantially the same as the platform 10 described hereinabove with the exception that the battered columns 612 of the platform 600 comprise two or more column members 614 joined together to form the battered columns 612. More preferably, the battered columns 612 comprise three or more column members 614 in longitudinal contact extending between the pontoons 18 and the deck 16. Fabrication of large diameter columns is very expensive and may require specially designed equipment to manipulate and transport. Under some circumstances it may be more economical to fabricate smaller diameter columns and bundle them together to form the columns 612. The column members 614 are welded or otherwise joined and may include one or more retaining rings (not shown in the drawings) fixed about the outer periphery thereof. Referring now to FIG. 10, an eighth embodiment of a battered column platform of the present invention is generally identified by the reference numeral 700. The platform 700 is substantially the same as the platform 10 described hereinabove with the exception that an open frame support structure 712 is mounted on the upper ends of the battered columns 12. The deck 16 is supported on the open frame support structures 712. Each support structure 712 defines a rigid open frame configuration, such as, a substantially rectangular or triangular support structure, formed by interconnected structural members 714. Although the columns 12 are only partially submerged during normal operating conditions, the open frame support structures 712 may provide some transparency to wind and wave forces during extreme storm events.

Figure 11:
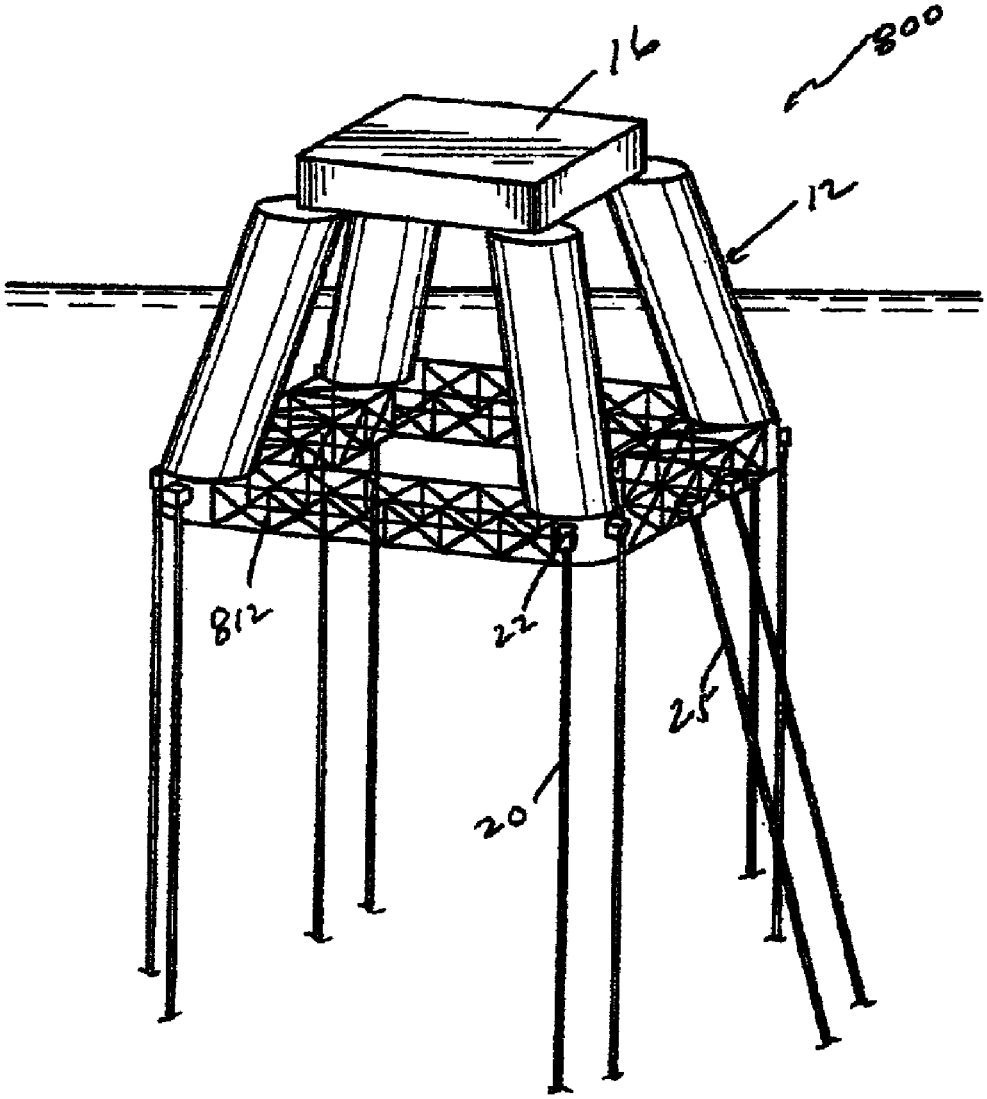
FIG. 11 is a perspective view illustrating a ninth preferred embodiment of an offshore platform of the present invention.

Referring now to FIG. 11, a ninth embodiment of a battered column platform of the present invention is generally identified by the reference numeral 800. The platform 800 is substantially the same as the platform 10 described hereinabove with the exception that the battered columns 12 of the platform 800 are interconnected at the lower ends thereof by interconnected members 812 which define an elongate open frame configuration, such as, a substantially rectangular or triangular configuration, disposed between the lower ends of the battered columns 12. Since members 812 provide relatively small buoyancy compared to conventional pontoons, primary buoyancy for the platform 800 is provided by the battered columns 12. The buoyancy requirements of the platform 800 may be provided by modifying the configuration of the columns 12. For example, the diameter and/or length of the column 12 may be increased or smaller diameter columns may be bundled together as shown in FIG. 9.

Figure 12:
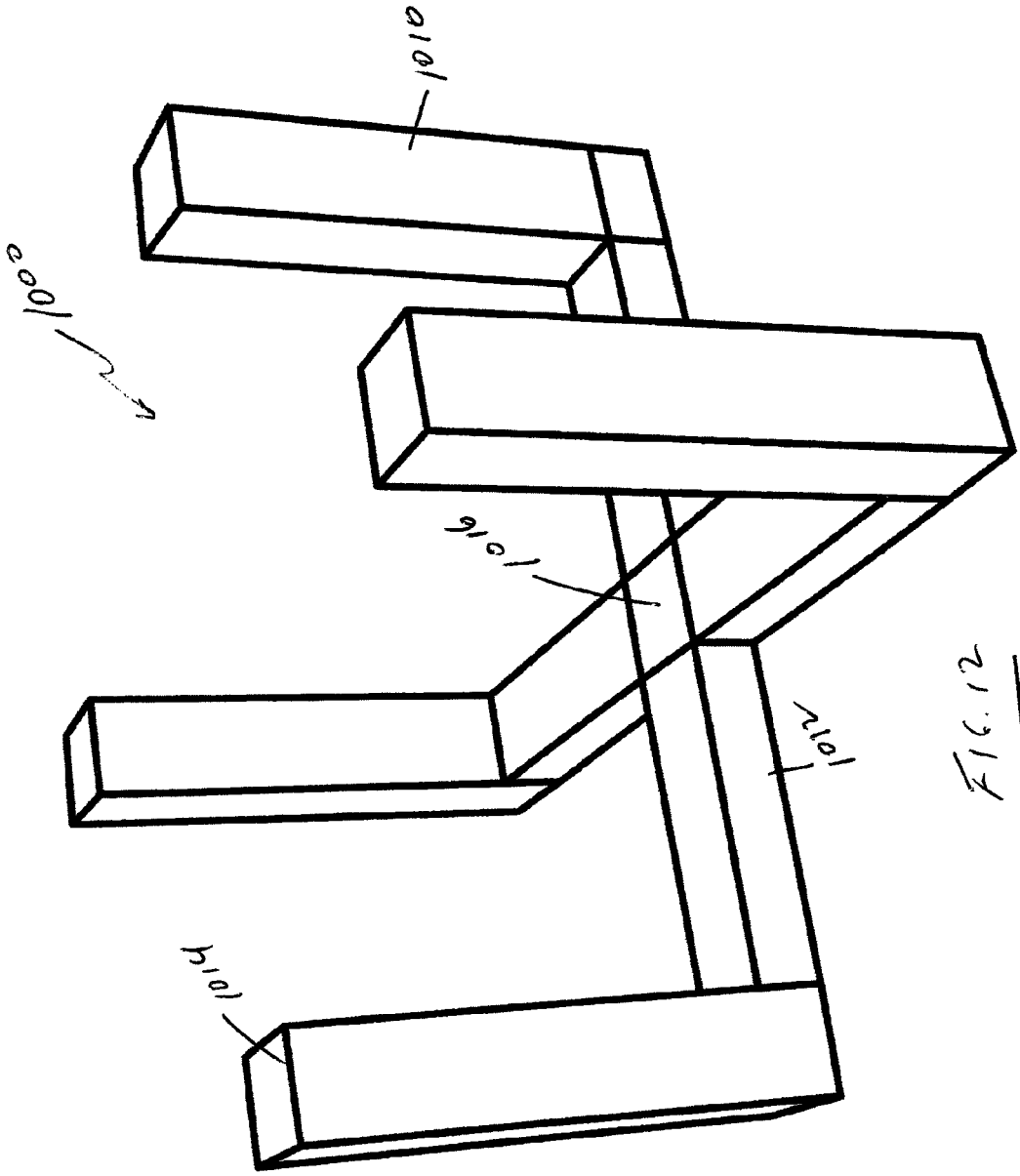
FIG. 12 is a perspective view illustrating a tenth preferred embodiment of an offshore platform of the present invention.
Figure 13C:
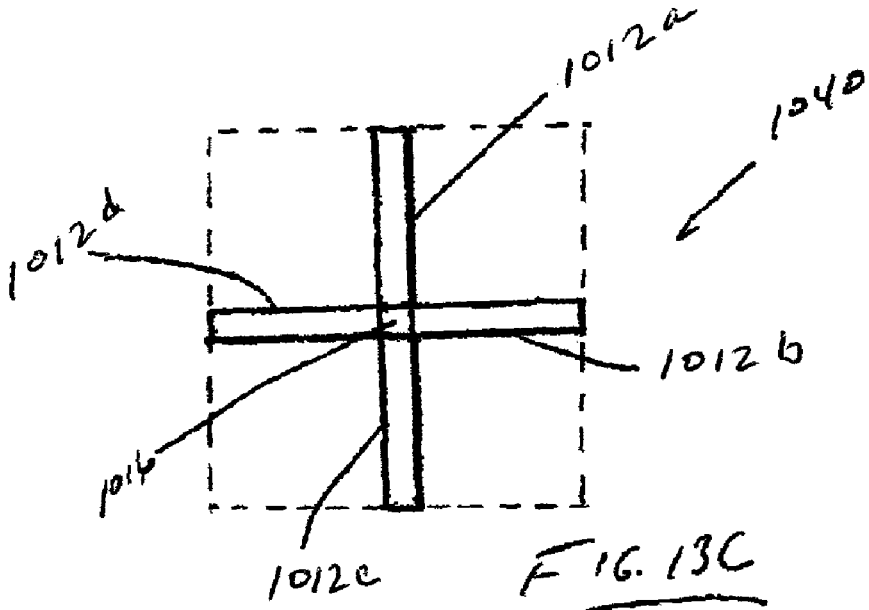
FIGS. 13A-13C are top plan views illustrating the deck areas of different hull configurations of the offshore platform shown in FIG. 12.
Figure 13B:
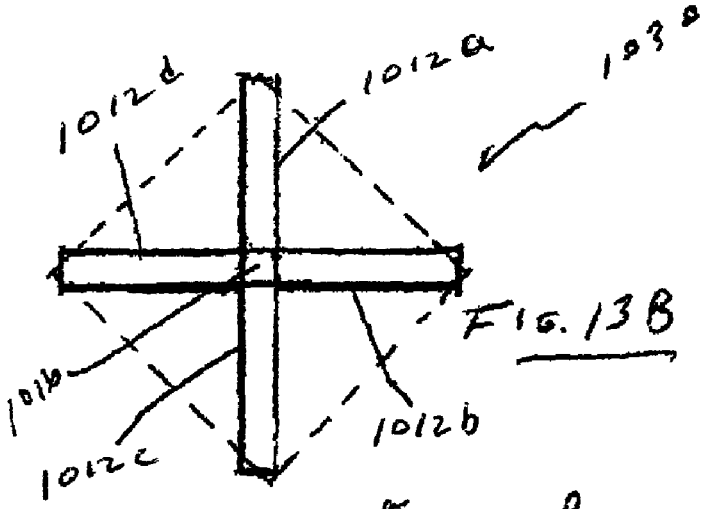
Figure 13A:
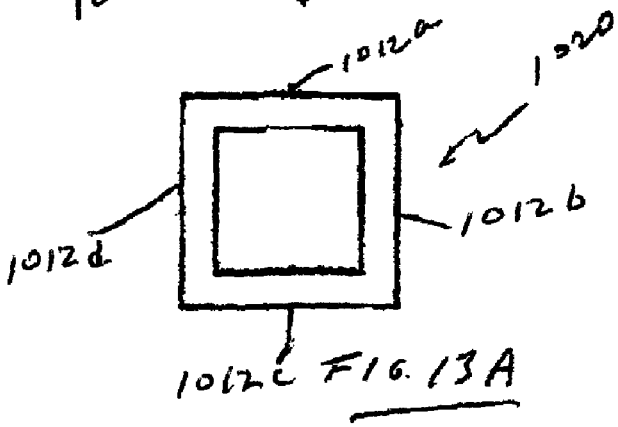

Referring now to FIG. 12, the hull configuration of a tenth embodiment of the present invention is generally identified by the reference numeral 1000. The hull 1000 includes support columns 1010 extending substantially vertically upward from horizontally oriented pontoons 1012 to support a deck (not shown in the drawings) above the water surface on the upper ends 1014 thereof. The support columns 1010 are mounted proximate the distal ends of the pontoons 1012. FIG. 12 shows four pontoons 1012 connected to a base node 1016 extending outward therefrom at right angles to each other so that, viewed from above, the base of the hull 1000 forms a cross shape. It is understood, however, that other configurations may be used. For example, a single pontoon or two pontoons connected end-to-end may be intersected by pontoons extending in directly opposite directions. The angles between adjacent pontoons may range between 60 to 120 degrees.

The cross hull design illustrated in FIGS. 12-18 permits the construction of a hull having a larger footprint than a box hull design with an equal amount of pontoon volume. A larger hull footprint provides greater stability during installation and operation of the platform. A cross hull design may also support a deck having a larger deck area than a box configuration hull design. For example, for a box shaped hull 1020, as shown in FIG. 13A, and pontoons 1012*a*, 1012*b*, 1012*c* and 1012*d* being 100 feet in length, the area of the deck would be about 10,000 square feet. However, the deck area of the crossed shaped hull 1030 shown in FIG. 13B (deck shown in phantom) would be about 20,000 square feet (the square root of 2 multiplied by 100 feet). Orienting the deck as shown in FIG. 13C, the deck width would be about 200 feet resulting in a deck area of about 40,000 square feet. A large deck area may eliminate the need for multiple deck levels and thereby lower the center of gravity of the platform. Likewise, the cross shaped hull design enables the hanging of risers, flow lines and the like closer to the center vertical axis of the platform and thereby maintains the platform center of gravity closer to the middle of the platform.

Figure 14:
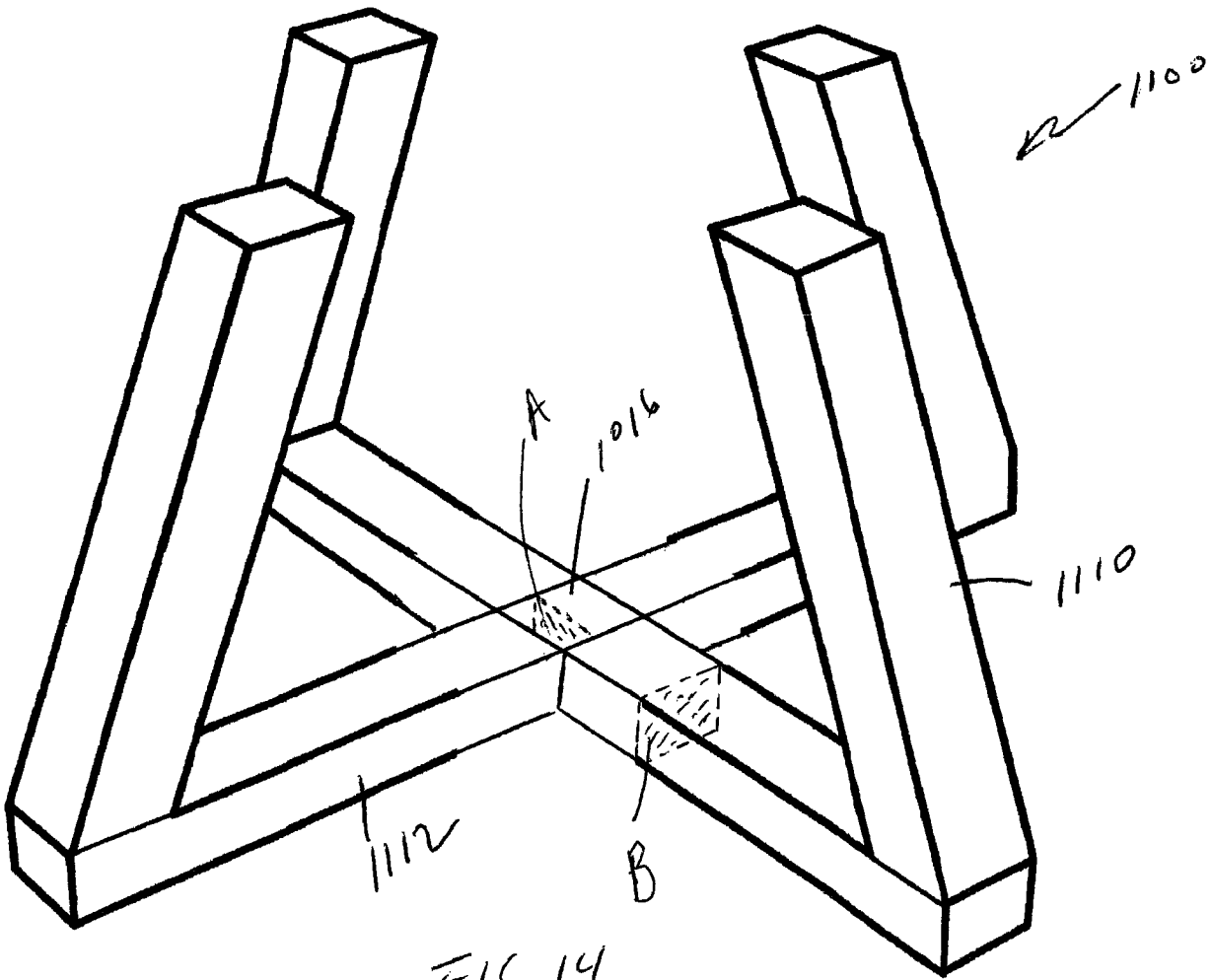
FIG. 14 is a perspective view illustrating an eleventh preferred embodiment of an offshore platform of the present invention.

Referring now to FIG. 14, an eleventh embodiment of the present invention is generally identified by the reference numeral 1100. The hull 1100 is substantially the same as the hull 1000 described above with reference to FIG. 12 with the exception that the support columns 1110 are battered inwardly toward the central vertical axis of the hull 1100.

Figure 15:
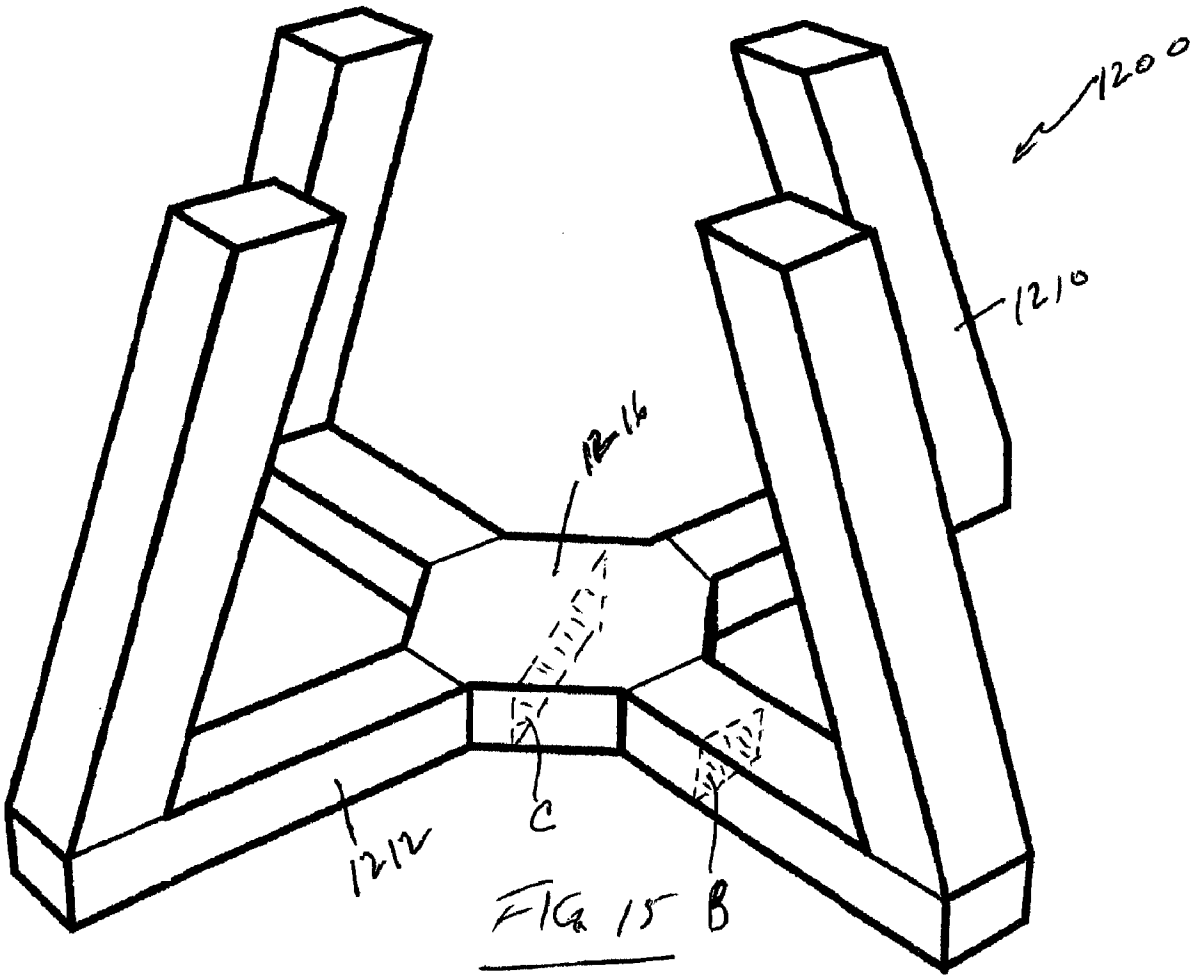
FIG. 15 is a perspective view illustrating a twelfth preferred embodiment of an offshore platform of the present invention.
Figure 15:
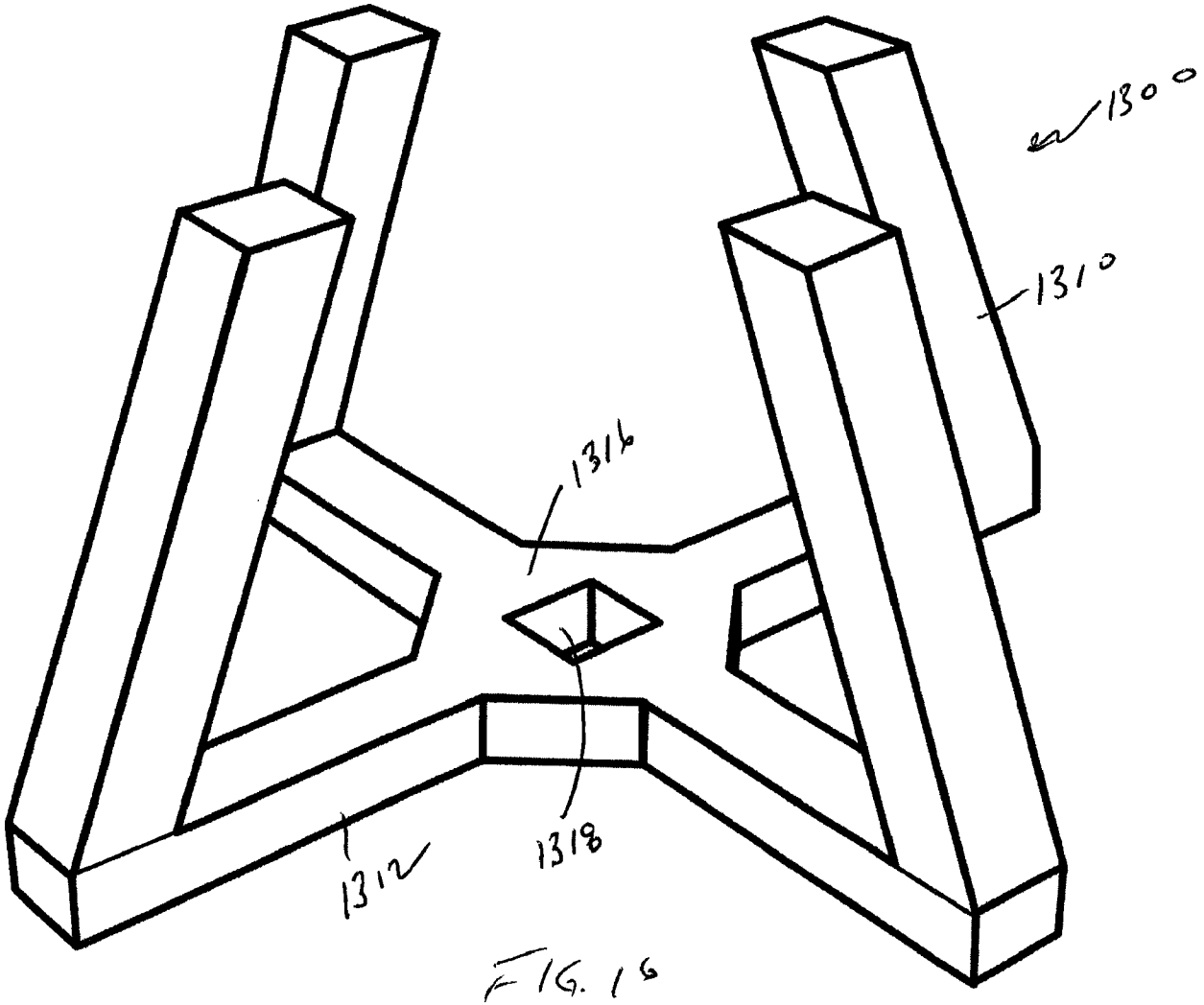

A twelfth embodiment of the present invention generally identified by the reference numeral 1200 is shown in FIG. 15. The hull 1200 is substantially the same as the hull 1100 described above with reference to FIG. 14 with the exception that the dimensions of the base node 1216 are greater than the dimensions of base node 1016 shown in FIG. 14. It will be observed that the vertical cross-section area A of the base node 1016 (shown as cross-hatching in FIG. 14) is substantially equal to the vertical cross-section area B of each of the pontoons 1212 but less than the vertical cross section area C of the base node 1216 (shown as cross-hatching in FIG. 15). The larger size of the base node 1216 adds mass and increases the stiffness of the mid section of the hull 1200.

Referring now to FIG. 16, a thirteenth embodiment of the present invention is generally identified by the reference numeral 1300. The hull 1300 is substantially the same as the hull 1200 described above with reference to FIG. 15 with the exception that the base node 1316 includes an axial passage 1318 extending through the base node 1316. The passage 1318 is centrally located and circumscribes the central vertical axis of the hull 1300. The passage 1318 provides a central passageway for a drill string or flow lines or the like to pass through.

Figure 17:
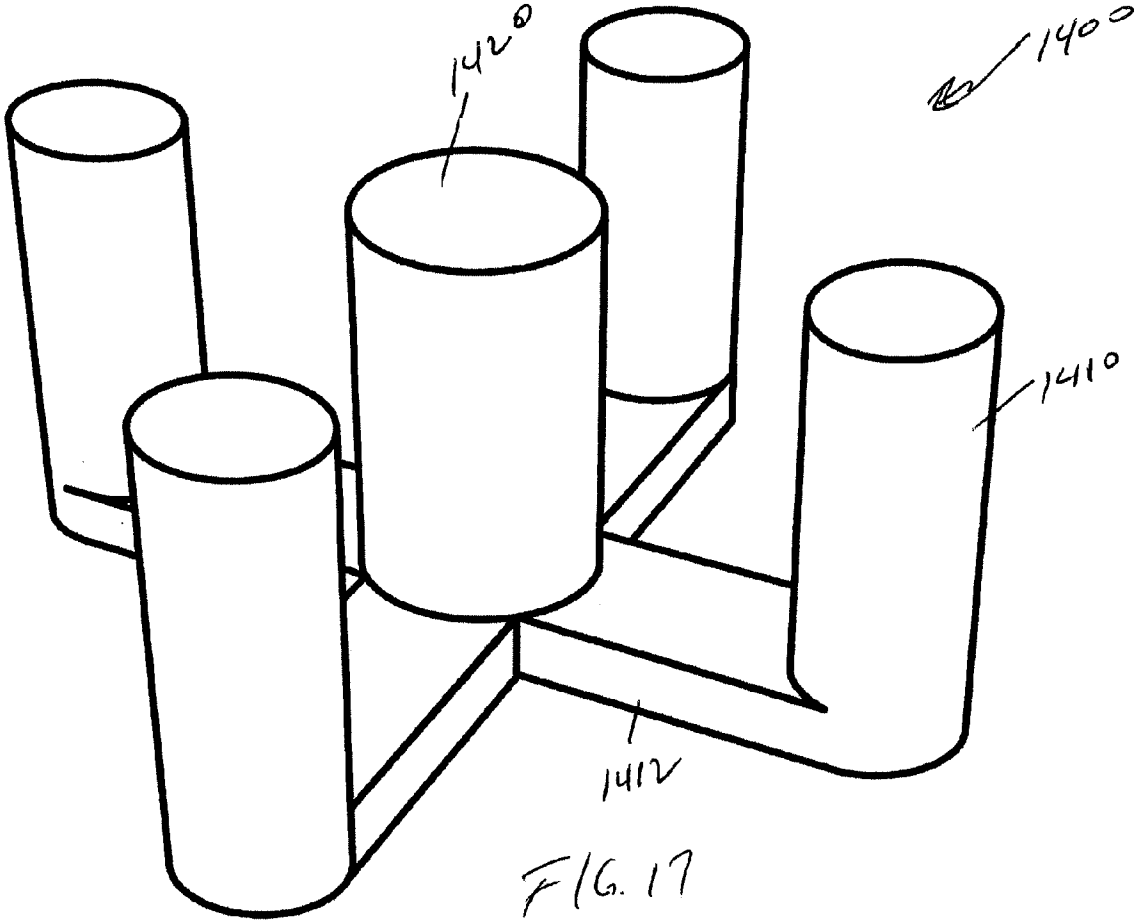
FIG. 17 is a perspective view illustrating a fourteenth preferred embodiment of an offshore platform of the present invention.

Referring now to FIG. 17, a fourteenth embodiment of the present invention is generally identified by the reference numeral 1400. The hull 1400 is substantially the same as the hull 1000 described above with reference to FIG. 12 with the exception that the hull 1400 includes a central column 1420 extending between the base node 1416 and the deck (not shown in the drawing) of the platform. The central column 1420 provides additional buoyancy for supporting a higher payload, particularly for platforms with large and/or multiple decks. The central column 1420 and the support columns 1410 mounted proximate the distal ends of the pontoons 1412 also provider additional capacity for increasing the buoyancy and/or modifying the hydrodynamic and/or hydrostatic characteristics of the hull 1400. It is further understood that the central and outer support columns may have a cylindrical, square or truss shape or a combination thereof to accommodate the buoyancy and hydrostatic/hydrodynamic design requirements for the platform.

Figure 18:
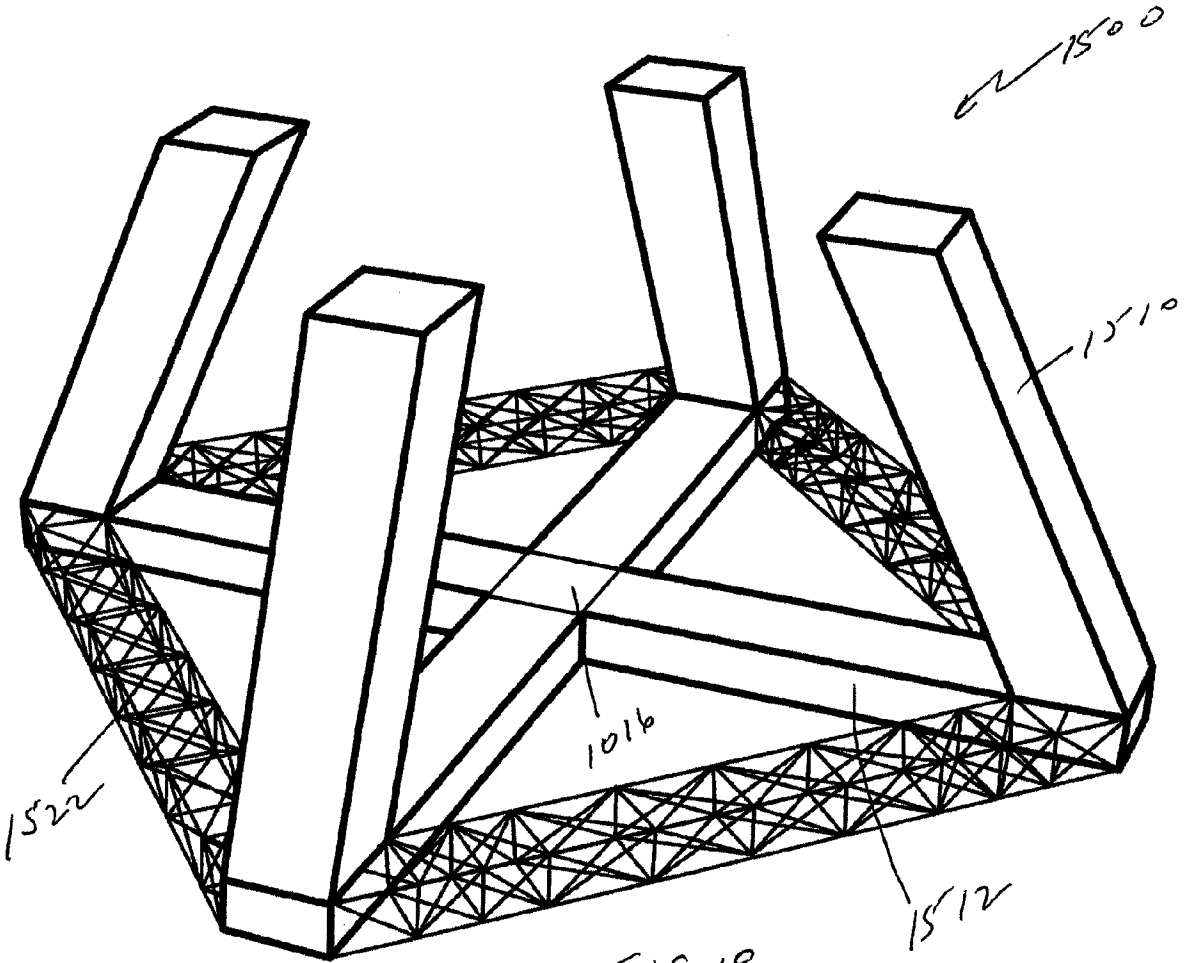
FIG. 18 is a perspective view illustrating a fifteenth preferred embodiment of an offshore platform of the present invention.

Referring now to FIG. 18, a fifteenth embodiment of the present invention is generally identified by the reference numeral 1500. The hull 1500 is substantially the same as the hull 1100 described above with reference to FIG. 14 with the exception that the hull 1500 includes trusses 1522 to increase the stiffness of the hull 1500. The trusses 1522 are open frame members disposed between the distal ends of the pontoons 1512. The trusses 1522 may also create additional mass traps that are beneficial to the motion behavior of the platform.

It will be observed that the embodiments of the invention described herein depict the pontoons and deck support columns as being cylindrical, rectangular or square in cross section. However, the pontoons and deck support columns may include other cross sectional shapes or configurations, as may be required by environmental conditions or other design considerations. For example, the square edges of the pontoons and/or the support columns may be rounded off to obtain lower drag forces. It is to be understood that the disclosed embodiments are merely exemplary of the invention that may be embodied in various and alternative forms and not intended to be limiting.

While a preferred embodiment of the invention has been shown and described, other and further embodiments of the invention may be devised without departing from the basic scope thereof, and the scope thereof is determined by the claims which follow.

The invention claimed is:

1. A buoyant hull for supporting an offshore platform above a water surface, said hull comprising:

a) a base node, wherein said base node includes a substantially vertical perimeter surface defining the vertical dimension of said base node;

b) horizontally disposed pontoons having a proximal end connected to said base node, said pontoons extending radially outwardly from said base node;

c) upwardly extending support columns fixedly secured proximate a distal end of said pontoons; and d) wherein said proximal end of said pontoons defines a pontoon end cross-section having a vertical dimension substantially matching the vertical dimension of said base node.

2. The buoyant hull of claim 1 wherein said support columns are battered inwardly toward a center vertical axis of said hull, said support columns extending upwardly from said pontoons to an elevation above the water surface.

3. The buoyant hull of claim 2 wherein said support columns define a first footprint and said deck defines a second footprint, and wherein said first footprint is larger than said second footprint.

4. The buoyant hull of claim 1 wherein said base node includes an axial passageway extending through the center thereof.

5. The buoyant hull of claim 1 including a central column fixedly secured on said base node extending upwardly from said base node to an elevation above the water surface.

6. The buoyant hull of claim 1 including horizontally disposed truss members interconnecting said pontoons proximate the distal ends thereof.

7. The buoyant hull of claim 1 wherein said support columns are battered inwardly at an angle less than 20 degrees from vertical.

8. The buoyant hull of claim 1 wherein said support columns include an upper portion battered inwardly beginning from an intermediate point between upper and lower ends of said support columns.

9. The buoyant hull of claim 1 wherein one or more of said support columns incline in a direction toward an adjacent one of said support columns.

10. The buoyant hull of claim 9 wherein the azimuth of one or more of said support columns is between zero and ninety degrees.

11. The buoyant hull of claim 1 wherein at least two of said support columns are battered toward each other and extend above an interconnecting member defining a vertical plane passing through the longitudinal axis of said at least two battered columns and the longitudinal axis of said interconnecting member.

12. The buoyant hull of claim 1 including a support structure formed by a plurality of interconnecting frame members secured on upper ends of said support columns for supporting a deck thereon.

13. An offshore floating platform, comprising:

a) a buoyant hull, said hull including a central base node and pontoons extending outwardly from said base node at angles between 60 to 120 degrees relative to each other, and wherein said base node includes a substantially vertical perimeter surface defining the vertical dimension of said base node;

b) a deck supported above a water surface on support columns mounted proximate a distal end of said pontoons;

c) wherein said support columns are battered inwardly toward a center vertical axis of said hull and extend upwardly from said pontoons to said deck;

d) one or more anchoring members having one end connected to said hull and an opposite end anchored to the seabed; and e) wherein a proximal end of said pontoons defines a pontoon end cross-section having a vertical dimension substantially matching the vertical dimension of said base node.

14. The platform of claim 13 including a plurality of frame members forming horizontally disposed truss members interconnecting said pontoons.

15. The platform of claim 13 wherein each of said support columns comprise a bundle of two or more elongate members secured together and in contact along a longitudinal surface thereof.

16. The platform of claim 13 wherein said pontoons extend radially outwardly from said base node at right angles relative to each other.

17. The platform of claim 13 wherein said base node includes an axial passageway extending through said base node.

18. The platform of claim 13 including a central column extending upwardly from said base node to said deck.

* * * * *